US008642863B2

(12) United States Patent
Del Priore et al.

(10) Patent No.: US 8,642,863 B2
(45) Date of Patent: Feb. 4, 2014

(54) CAPO

(75) Inventors: Andy Del Priore, Smithtown, NY (US); Steven C. Pfister, Atlanta, GA (US)

(73) Assignee: Del Capo Company, Smithtown, NY (US)

( * ) Notice: Subject to any disclaimer, the term of this patent is extended or adjusted under 35 U.S.C. 154(b) by 0 days.

(21) Appl. No.: 13/063,680

(22) PCT Filed: Sep. 11, 2009

(86) PCT No.: PCT/US2009/056755
§ 371 (c)(1), (2), (4) Date: Oct. 31, 2011

(87) PCT Pub. No.: WO2010/030959
PCT Pub. Date: Mar. 18, 2010

(65) Prior Publication Data

US 2012/0036978 A1 Feb. 16, 2012

Related U.S. Application Data

(60) Provisional application No. 61/191,732, filed on Sep. 11, 2008.

(51) Int. Cl.
*G10D 3/00* (2006.01)

(52) U.S. Cl.
USPC ..... 84/318

(58) Field of Classification Search
None
See application file for complete search history.

(56) References Cited

U.S. PATENT DOCUMENTS

| | | | | | |
|---|---|---|---|---|---|
| 3,680,427 | A * | 8/1972 | Valentino | 84/456 |
| 3,776,088 | A * | 12/1973 | Jones | 84/317 |
| 3,818,793 | A * | 6/1974 | Round | 84/454 |
| 3,915,051 | A * | 10/1975 | Kincaid | 84/317 |
| 3,995,523 | A * | 12/1976 | Clarke | 84/317 |
| 4,030,400 | A * | 6/1977 | Del Castillo | 84/317 |
| 4,183,279 | A * | 1/1980 | Shabram, Jr. | 84/318 |
| 4,334,457 | A * | 6/1982 | Spoonts, III | 84/318 |
| 4,926,732 | A * | 5/1990 | Collins et al. | 84/318 |
| 5,101,706 | A * | 4/1992 | Kilgore | 84/318 |
| 5,287,788 | A * | 2/1994 | Hill, Jr. | 84/315 |
| 5,623,110 | A * | 4/1997 | Hoglund et al. | 84/318 |
| 6,723,905 | B2 * | 4/2004 | Gillis | 84/318 |
| 7,557,285 | B2 * | 7/2009 | Ward | 84/422.1 |
| 7,563,969 | B2 * | 7/2009 | Einhorn et al. | 84/318 |
| 2007/0227334 | A1 * | 10/2007 | Ward | 84/318 |
| 2012/0036978 | A1 * | 2/2012 | Del Priore et al. | 84/318 |

* cited by examiner

*Primary Examiner* — Robert W Horn
(74) *Attorney, Agent, or Firm* — Ballard Spahr LLP

(57) ABSTRACT

The invention relates to a capo for use with a stringed instrument. In one aspect, the capo can comprise at least one string compressor, a frame having a longitudinal axis, and a means for individually moving the at least one string compressor that is configured to allow for the individual movement of contact portions of the at least one string compressor from a raised position to a depressed position, which is at a predetermined depth from a bottom surface of the frame. This movement of the string compressor allows for the selective application of pressure to at least one string on the instrument so that, in the depressed position, the contact portion of the selected string compressor presses a selected string among the at least one strings against the fretboard of the stringed instrument.

26 Claims, 13 Drawing Sheets

CAPO

CONTINUITY

This application is a 35 U.S.C. §371 national phase application of International Application No. PCT/US2009/056755, filed Sep. 11, 2009, which claims priority to U.S. Patent Application No. 61/191,732, filed Sep. 11, 2008, the entire disclosures of which are all herein incorporated by reference in their entireties.

FIELD OF THE INVENTION

This invention relates to a capo for use on a guitar or other stringed instrument. More specifically, this invention relates to a capo for selectively applying pressure to one or more strings of a guitar or other stringed instrument.

BACKGROUND OF THE INVENTION

Commonly known capos consist of a solid frame that is secured across the strings of a guitar or other stringed instrument to selectively control the tuning of the strings. Commonly known capos often consist of spring mechanisms that allow for quick clamping to the neck of the instrument. However, these capos do not permit users to provide compression to any combination of strings within a single fret of the neck of the instrument.

It is also known that capos can consist of one or more members that can be individually lowered to provide compression to a selected string. However, these capos do not typically provide enough clamping force for steel strings. In addition, these capos do not typically are difficult to operate and move along the neck of the guitar.

Thus, there is a need in the pertinent art for a capo that can provide compression to selected individual strings within a fret of a guitar while allowing for quick adjustment of the applied compression and easy movement along the neck of the guitar.

SUMMARY

The invention relates to a capo for use with a stringed instrument. In one aspect, the stringed instrument has at least one string and a neck that has a length and a variable or tapered width. In another aspect, a fretboard of the instrument is formed by at least a portion of the upper surface of the neck. Conventionally, in a relaxed position, each string of the stringed instrument is positioned above or otherwise is spaced from the fretboard.

In one aspect, the capo can comprise at least one string compressor, a frame having a longitudinal axis, and means for individually moving the at least one string compressor. In this aspect, each string compressor of the at least one string compressor can have a contact portion that is configured to operatively contact a desired at least one string. In another aspect, the frame can have a recessed portion that extends along or relative to the frame's longitudinal axis that is configured, when the capo is operatively mounted thereon the neck of the stringed instrument, to position the contact portions of the at least one string compressor at a raised position relative to the at least one string and the fretboard.

In one aspect, the means for individually moving the at least one string compressor is configured to allow for the individual movement of the contact portions of the at least one string compressor from the raised position to a depressed position that is at a predetermined depth from a bottom surface of the frame. As one will appreciate, this movement allows for the selective application of pressure to at least one string on the instrument so that, in the depressed position, the contact portion of the selected string compressor presses a selected string among the at least one strings against the fretboard.

In a further aspect, it is also contemplated that the capo can comprise a means for selectively fixing the frame thereto a selected portion along the length of the neck of the instrument such that the bottom surface of the frame is positioned at a predetermined distance above the fretboard.

DESCRIPTION OF THE FIGURES

These and other features of the preferred embodiments of the invention will become more apparent in the detailed description in which reference is made to the appended drawings wherein.

DETAILED DESCRIPTION OF THE INVENTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a tube" can include two or more such tubes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 1:
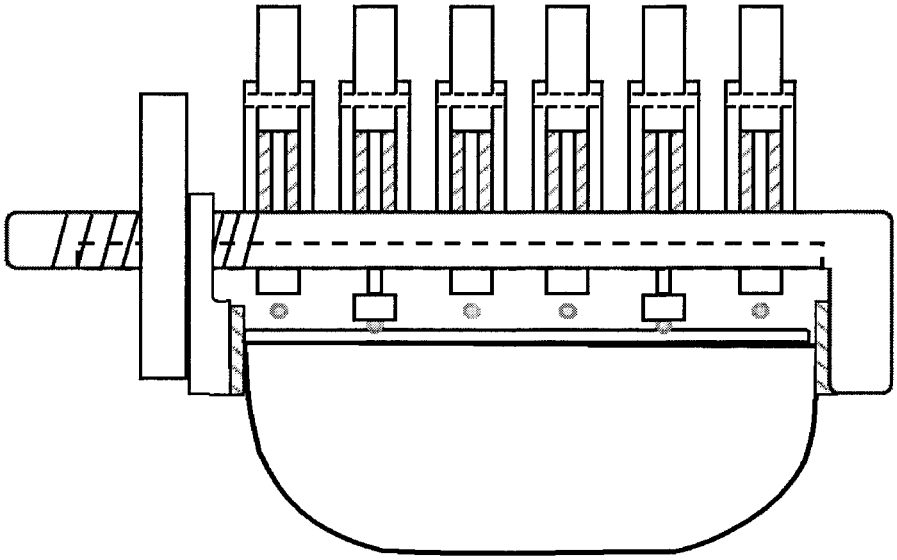
FIG. 1 is a partial cross-sectional view of one embodiment of a capo mounted thereon a portion of a neck of a stringed instrument, and showing the contact portions of two string compressors positioned in the depressed position and the contact portions of four string compressors positioned in the raised position.
Figure 2:
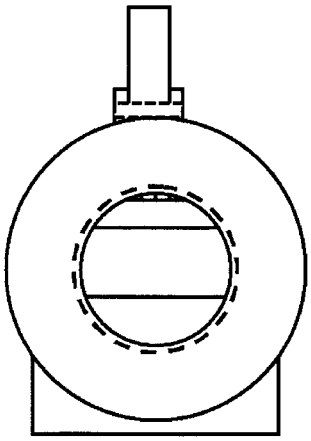
FIG. 2 is a left side elevational view of the embodiment of the capo depicted in FIG. 1.

In one embodiment, and as shown in FIGS. 1 and 2, the invention comprises a capo for use with an instrument having at least one string. The instrument can be, for example and without limitation, a guitar, a cello, a violin, and the like. In one aspect, the instrument can have a neck. In this aspect, the neck of the stringed instrument can have a length and a width. As one having ordinary skill in the art will appreciate, the necks of many stringed instruments can have variable widths. Thus, it is contemplated that the stringed instrument can have a variable width. In another aspect, an upper surface of the neck can define a fretboard. In an additional aspect, each string of the at least one string can be positioned in a relaxed position. In this aspect, in the relaxed position, each string of the at least one string can be positioned above the fretboard at a desired distance or at a desired spacing (i.e., at a conventional spacing). As one having ordinary skill in the art will appreciate, the strings of stringed instruments can be configured to be suspended above the fretboard in the absence of pressure applied by a user of the instrument.

Figure 3:
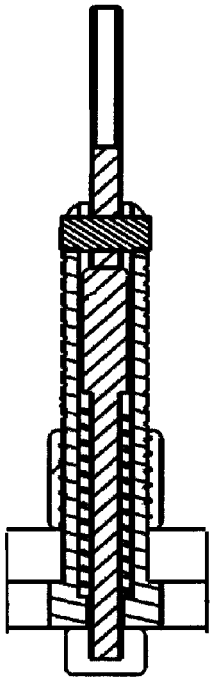
FIG. 3 is a cross-sectional view of one embodiment of a string compressor of the capo having an actuator herein.

In one aspect, and as shown in FIG. 1 and FIG. 3, the capo can comprise at least one string compressor. In this aspect, each string compressor of the at least one string compressor can have a contact portion configured to contact the at least one string of the instrument. In another aspect, the contact portion of each string compressor can comprise a padded portion. For example, and without limitation, it is contemplated that the padded portion can comprise rubber, foam, and other materials that can transmit sufficient force to the at least one string to securely hold the at least one string against the fretboard without damaging the at least one string or the instrument itself.

In another aspect, and as shown in FIGS. 1 and 2, the capo can comprise a frame having a longitudinal axis. In one aspect, the frame can have a recessed portion extending longitudinally. In this aspect, it is contemplated that the recessed portion can be configured to position the contact portions of the at least one string compressor at a raised position relative to the at least one string and the fretboard. Thus, as one having ordinary skill in the art will appreciate, the frame can be used to position the contact portions of the string compressors at a spaced position above the strings and the fretboard of the instrument. As one having ordinary skill in the art will further appreciate, the frame can be dimensioned so as to span across the width of the neck of the instrument.

In an additional aspect, the capo can comprise means for individually moving the contact portions of the at least one string compressor. In this aspect, the means for individually moving the contact portions of the at least one string compressor can be used to move the contact portions from the raised position to a depressed position at a predetermined depth from a bottom surface of the frame. As one having ordinary skill in the art will appreciate, it is contemplated that, upon positioning of the contact portions in the depressed position, the contact portions can selectively apply pressure to at least one string on the instrument. In a further aspect, it is contemplated that, in the depressed position, the contact portion of each string compressor of the at least one string compressor presses a selected string among the at least one string against the fretboard. As one having ordinary skill in the art will further appreciate, users of the capo described herein can selectively apply pressure to individual strings within a single fret of an instrument to produce desired tunings for each individual string of the instrument.

In a further aspect, the capo can further comprise means for selectively fixing the frame thereto a selected portion along the length of the neck of the instrument. In this aspect, it is contemplated that the frame can be fixed to the selected portion of the neck such that the bottom surface of the frame is positioned at a predetermined distance above the fretboard. It is specifically contemplated that the predetermined distance can be greater than the predetermined depth by which the contact portions are lowered from the bottom surface of the frame in the depressed position.

In one aspect, and with reference to FIG. 1, each string compressor of the at least one string compressor can be selectively axially moveable along the recessed portion of the frame. In this aspect, it is contemplated that the at least one string compressor can be moveable along the longitudinal axis of the frame. In another aspect, the recessed portion of the frame can comprise slotted opposed sides. In this aspect, it is contemplated that the string compressors can be configured for sliding engagement thereby the slots in the opposed sides of the recessed portion. As one having ordinary skill in the art will appreciate, the slots can correspond to incremental positions along the longitudinal length of the recessed portion. As one having ordinary skill in the art will further appreciate, the slots can provide additional stability to the string compressors to ensure that an appropriate spatial relationship with the strings is maintained.

Figure 7:
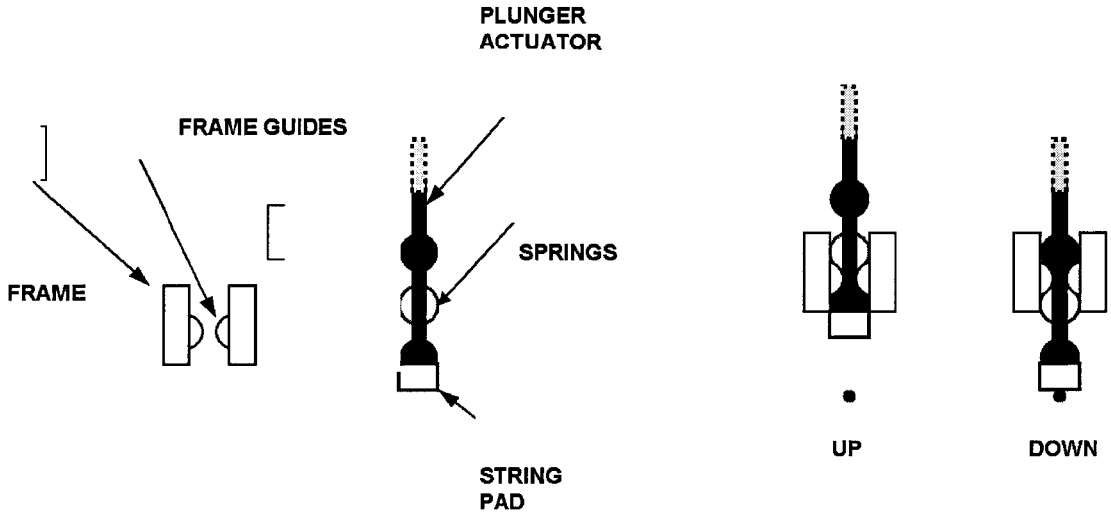
FIG. 7 depicts an optional embodiment of a string compressor, showing a housing and a plunger configured for selective movement between the raised and depressed positions, and showing the relative movement of the contact portion of the string compressor relative to a string of the instrument mechanism.
Figure 8:
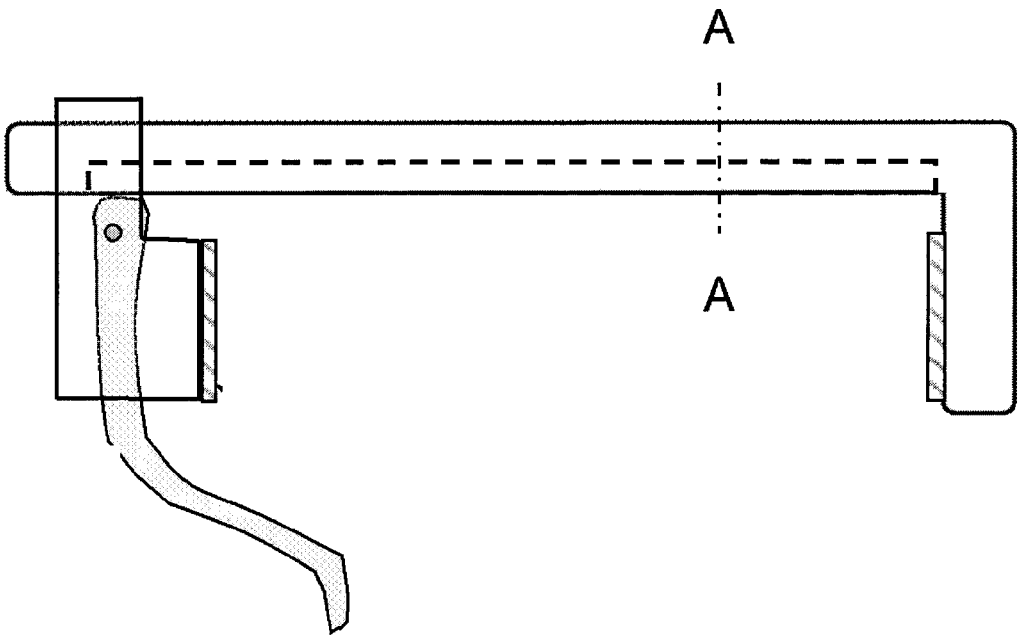
FIG. 8 is a front elevational view of one embodiment of a frame of the capo and showing one embodiment for a means for selectively fixing the frame thereto a selected portion along the length of the neck of the instrument.
Figure 9:
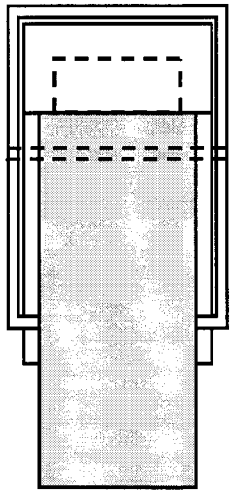
FIG. 9 is a side elevational view of the frame depicted in FIG. 8.
Figure 10:
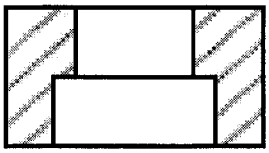
FIG. 10 is a cross-sectional view of the frame depicted in FIG. 8 taken along the plane A-A.
Figure 11:
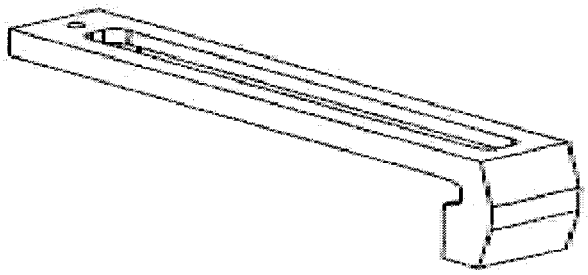
FIG. 11 is a perspective view of the frame depicted in FIG. 8.

In a further aspect, and with reference to FIG. 7, each string compressor of the at least one string compressor can comprise a plunger assembly. In one aspect, the plunger assembly can comprise a housing having at least one opening. In another aspect, the plunger assembly can comprise a plunger. In this aspect, the plunger can have an elongate shaft having having a distal end and a proximal end. In an additional aspect, the elongate shaft can comprise a first shoulder positioned at a distal end of the elongate shaft. In a further aspect, the elongate shaft can comprise a second shoulder positioned intermediate the distal end and the proximal end of the elongate shaft. In still a further aspect, the housing can comprise at least one bump. In this aspect, it is contemplated that the at least one bump can comprise two opposed bumps on opposed sides of the opening of the housing. In another aspect, the opening of the housing can have a diameter that is at least equal to the diameter of the first and second shoulders of the plunger. In this aspect, the distance between the two opposed bumps can be less than the diameter of the first and second shoulders of the plunger. In an additional aspect, the plunger can be moveable axially therein the opening of the housing.

It is contemplated that, in the raised position of the string compressor, the second shoulder can be spaced from the opposed bumps and the first shoulder can be positioned proximate a lower portion of the opposed bumps. It is further contemplated that, in the depressed position of the string compressor, the second shoulder can abut an upper portion of the opposed bumps and the first shoulder can be spaced from the opposed bumps. As one having ordinary skill in the art will appreciate, the diameter of the second shoulder of the plunger is too large to pass through the opposed bumps within the housing. Therefore, as one or ordinary skill in the art will further appreciate, the distance between the second shoulder and the fretboard can be substantially consistent every time the string compressor is lowered to the depressed position.

In another aspect, and with reference to FIGS. 3-7, the means for individually moving the contact portions of the at least one string compressor can comprise at least one actuator. In this aspect, it is contemplated that each actuator can be in operative communication with a string compressor of the at least one string compressor. In an additional aspect, each actuator can be selectively moveable between a first position and a second position. In this aspect, it is contemplated that the first position of the actuator can correspond to the raised position of the contact portions of the at least one string compressor. It is further contemplated that the second position of the actuator can correspond to the depressed position of the contact portions of the at least one string compressor. As one having ordinary skill in the art will appreciate, the actuator allows a user of the instrument to quickly change the position of the actuator from the first position to the second position, thereby allowing for quick and efficient application of pressure to a selected string by the string compressor.

Figure 4:
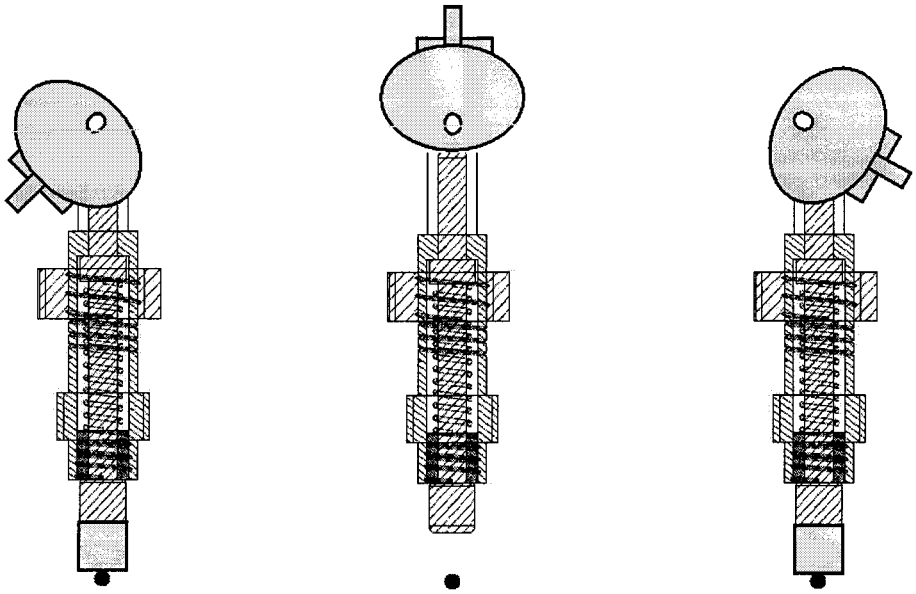
FIG. 4 are cross-sectional views of one embodiment of a string compressor of the capo having an actuator comprising a cam that effects the movement of the string compressor between the raised and depressed positions, and showing the relative movement of the contact portion of the string compressor relative to a string of the instrument.
Figure 5:
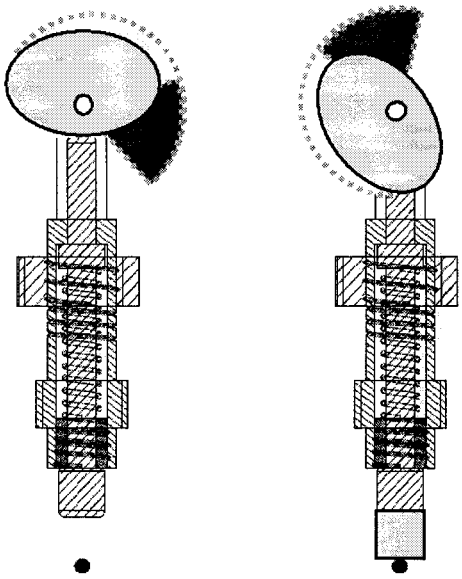
FIG. 5 are cross-sectional views of an optional embodiment of a string compressor of the capo having an actuator comprising a cam that effects the movement of the string compressor between the raised and depressed positions, and showing the relative movement of the contact portion of the string compressor relative to a string of the instrument.
Figure 6:
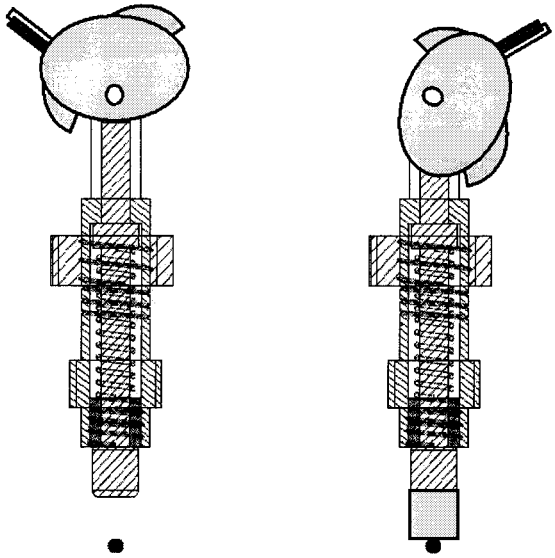
FIG. 6 are cross-sectional views of an optional embodiment of a string compressor of the capo having an actuator comprising a cam that effects the movement of the string compressor between the raised and depressed positions, and showing the relative movement of the contact portion of the string compressor relative to a string of the instrument.

In an additional aspect, each actuator of the at least one actuator can comprise a cam. In one aspect, and as shown in FIG. 4, the cam can be a three-position cam that is operatively coupled to the string compressor. In this aspect, the cam can have two positions corresponding to the depressed position of the contact portions and one position corresponding to the raised position of the contact portions. As one having ordinary skill in the art will appreciate, the three-position cam can be configured for sliding between positions. In another aspect, and as shown in FIGS. 5 and 6, the cam can be a two-position cam that is operatively coupled to the string compressor. In this aspect, the cam can have one position corresponding to the depressed position of the contact portions and one position corresponding to the raised position of the contact portions. As one having ordinary skill in the art will appreciate, the two-position cam can be configured for sliding between positions. As one having ordinary skill in the art will further appreciate, levers and other known mechanical components can be used as cams provided the components are in operative communication with a string compressor such that the component can be easily rotated or slid to effect a position change in the string compressor.

In one aspect, and with reference to FIGS. 8-11, the means for selectively fixing the frame thereto a selected portion along the length of the neck of the stringed instrument can comprise a sliding cam lock. In this aspect, the sliding cam lock can be configured to slide along the longitudinal axis of the frame.

Figure 12:
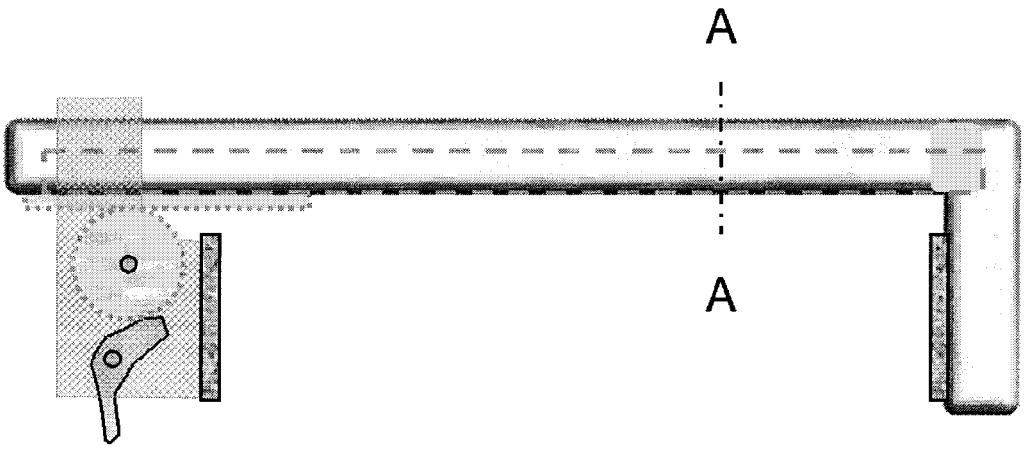
FIG. 12 is a front elevational view of an optional embodiment of a frame of the capo and showing one embodiment for a means for selectively fixing the frame thereto a selected portion along the length of the neck of the instrument.
Figure 13:
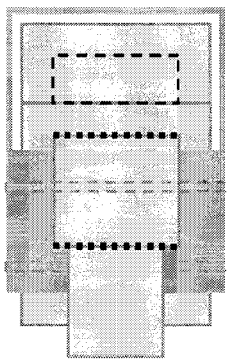
FIG. 13 is a side elevational view of the frame depicted in FIG. 12.

In another aspect, and with reference to FIGS. 12-13, the means for selectively fixing the frame thereto a selected portion along the length of the neck of the stringed instrument can comprise a ratcheting gear lock. In this aspect, the ratcheting gear lock can be configured to slide along the longitudinal axis of the frame.

Figure 14:
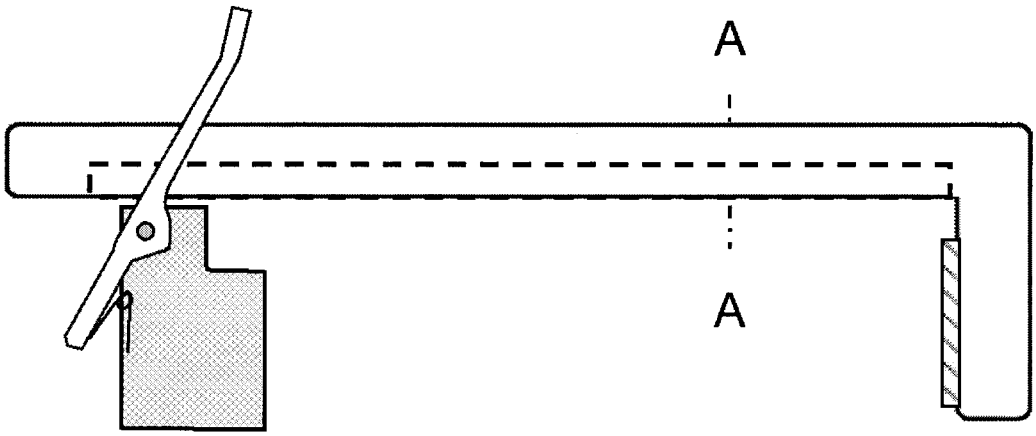
FIG. 14 is a front elevational view of an optional embodiment of a frame of the capo and showing one embodiment for a means for selectively fixing the frame thereto a selected portion along the length of the neck of the instrument.
Figure 15:
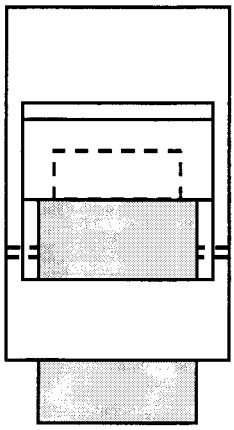
FIG. 15 is a side elevational view of the frame depicted in FIG. 14.

In an additional aspect, and with reference to FIGS. 14-15, the means for selectively fixing the frame thereto a selected portion along the length of the neck of the instrument can comprise a sliding grip claim. In this aspect, the sliding grip claim can be configured to slide along the longitudinal axis of the frame.

Figure 16:
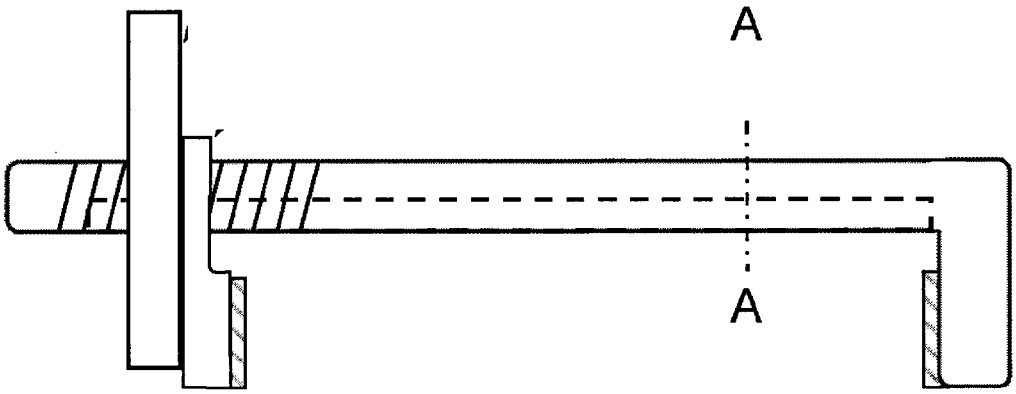
FIG. 16 is a front elevational view of an optional embodiment of a frame of the capo and showing one embodiment for a means for selectively fixing the frame thereto a selected portion along the length of the neck of the instrument.
Figure 17:
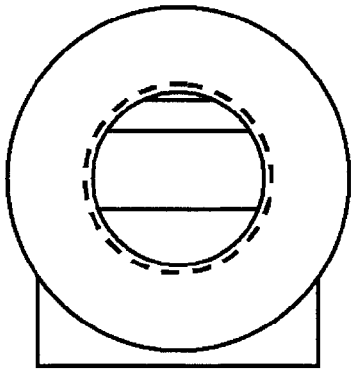
FIG. 17 is a side elevational view of the frame depicted in FIG. 16.

In a further aspect, and with reference to FIGS. 16-17, at least a portion of the frame can be threaded. In this aspect, the means for selectively fixing the frame thereto a selected portion along the length of the neck of the stringed instrument can comprise a screw clamp. In another aspect, the screw clamp can be configured for threaded engagement by the threaded portion of the frame.

Figure 18:
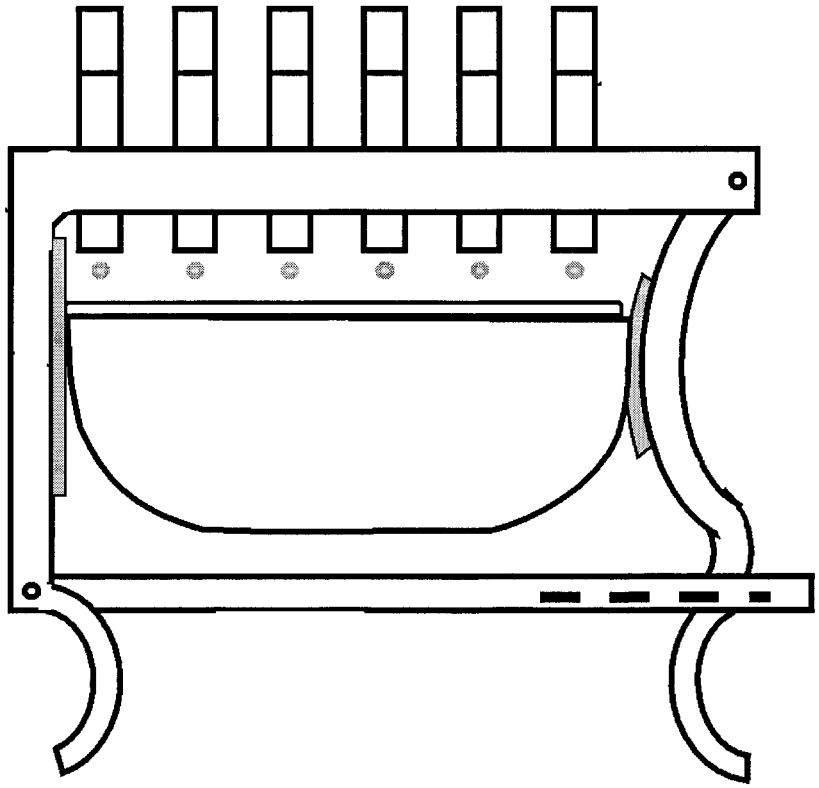
FIG. 18 is a front elevational view of an optional embodiment of a frame of the capo and showing one embodiment for a means for selectively fixing the frame thereto a selected portion along the length of the neck of the instrument.

In still a further aspect, and with reference to FIG. 18, the means for selectively fixing the frame thereto a selected portion along the length of the neck of the stringed instrument can comprise a squeeze clamp. In this aspect, the frame can comprise a plurality of pivoting members that can be selectively positioned on all sides of the neck of the instrument, and at least one pivoting member can comprise means for locking the squeeze clamp in an abutting position relative to the neck of the instrument.

Figure 19:
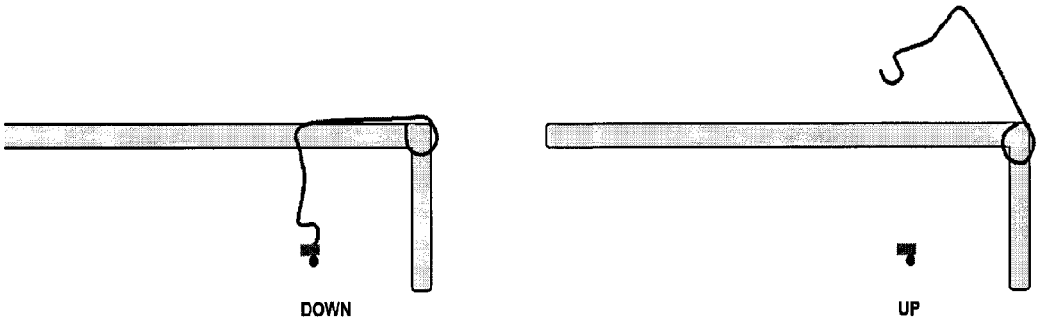
FIG. 19 depicts the movement of a position alignment finger between an up position and a down position.

In another aspect, and with reference to FIG. 19, the frame can comprise at least two opposed position alignment fingers. In one aspect, the position alignment fingers can be configured to face inwardly toward the strings of the instrument. In another aspect, the position alignment fingers can comprise a substantially curved member for engagement with at least one string of the instrument. As one having ordinary skill in the art will appreciate, the position alignment fingers can be engaged with strings of the instrument to provide added stability to the capo prior to securing of the frame. As one having ordinary skill in the art will further appreciate, the position alignment fingers can assist a user of the instrument with ensuring that the frame is positioned at a desired position relative to the neck of the instrument.

Figure 20:
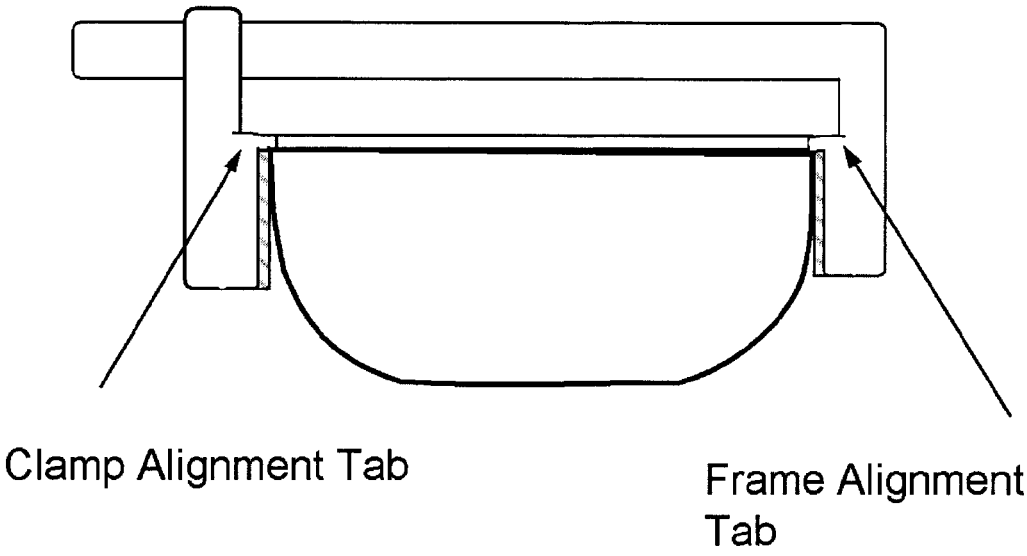
FIG. 20 is a front elevational view of an optional embodiment of a frame of the capo that has alignment tabs and showing one embodiment for a means for selectively fixing the frame thereto a selected portion along the length of the neck of the instrument.

In a further aspect, and with reference to FIG. 20, the frame can comprise at least one alignment tab for positioning thereon a portion of the neck of the guitar proximate the fretboard. As one having ordinary skill in the art will appreciate, alignment tabs can be positioned on opposed sides of the neck of the instrument to confirm proper alignment of the frame across the width of the neck.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A capo for use with an instrument having at least one string, the instrument having a neck that has a length and a variable width, wherein an upper surface of the neck defines a fretboard, wherein, in a relaxed position, each string of the at least one string is positioned above the fretboard, the capo comprising:

at least one string compressor, wherein each string compressor of the at least one string compressor has a contact portion configured to contact the at least one string;

a frame having a longitudinal axis, wherein the frame has a recessed portion extending longitudinally, and wherein the recessed portion is configured to position the contact portions of the at least one string compressor at a raised position relative to the at least one string and the fretboard;

means for individually moving the contact portions of the at least one string compressor from the raised position to a depressed position, which is at a predetermined depth from a bottom surface of the frame, to selectively apply pressure to at least one string on the instrument; and means for selectively fixing the frame to a selected portion along the length of the neck of the instrument such that the bottom surface of the frame is positioned at a predetermined distance above the fretboard, wherein the predetermined distance is greater than the predetermined depth, and wherein the means for selectively fixing the frame to a selected portion along the length of the neck of the instrument comprises a ratcheting gear lock, wherein the ratcheting gear lock is configured to slide along the longitudinal axis of the frame, wherein, in the depressed position, the contact portion of each string compressor of the at least one string compressor presses a selected string among the at least one string against the fretboard.

2. The capo of claim 1, wherein the contact portion of each string compressor comprises a padded portion.

3. The capo of claim 1, wherein each string compressor of the at least one string compressor is selectively axially moveable therein the recessed portion of the frame along the longitudinal axis of the frame.

4. The capo of claim 1, wherein the means for individually moving the contact portions of the at least one string compressor comprises at least one actuator, wherein each actuator of the at least one actuator is in operative communication with a string compressor of the at least one string compressor, wherein each actuator of the at least one actuator is selectively moveable between a first position and a second position, wherein the first position of the actuator corresponds to the raised position of the contact portions of the at least one string compressor, and wherein the second position of the actuator corresponds to the depressed position of the contact portions of the at least one string compressor.

5. The capo of claim 4, wherein each actuator comprises a cam.

6. The capo of claim 1, wherein each string compressor of the at least one string compressor comprises a plunger assembly, the plunger assembly comprising:

a housing having at least one opening; and a plunger having an elongate shaft, the elongate shaft having a distal end and a proximal end, wherein the elongate shaft comprises:

a first shoulder positioned at a distal end of the elongate shaft; and a second shoulder positioned intermediate the distal end and the proximal end of the elongate shaft, wherein the housing comprises two opposed bumps on opposed sides of the opening of the housing, wherein the opening of the housing has a diameter that is at least equal to the diameter of the first and second shoulders of the plunger, wherein the distance between the two opposed bumps is less than the diameter of the first and second shoulders of the plunger predetermined distance greater than the distance between the two opposed bumps, wherein the plunger is moveable axially therein the opening of the housing, wherein, in the raised position of the string compressor, the second shoulder is spaced from the opposed bumps and the first shoulder is positioned proximate a lower portion of the opposed bumps, and wherein, in the depressed position of the string compressor, the second shoulder abuts an upper portion of the opposed bumps and the first shoulder is spaced from the opposed bumps.

7. The capo of claim 6, wherein the means for individually moving the contact portions of the at least one string compressor comprises at least one actuator, wherein each actuator of the at least one actuator is in operative communication with a string compressor of the at least one string compressor, wherein each actuator of the at least one actuator is selectively moveable between a first position and a second position, wherein the first position of the actuator corresponds to the raised position of the contact portions of the at least one string compressor, and wherein the second position of the actuator corresponds to the depressed position of the contact portions of the at least one string compressor.

8. The capo of claim 7, wherein each actuator comprises a cam.

9. A capo for use with an instrument having at least one string, the instrument having a neck that has a length and a variable width, wherein an upper surface of the neck defines a fretboard, wherein, in a relaxed position, each string of the at least one string is positioned above the fretboard, the capo comprising:

at least one string compressor, wherein each string compressor of the at least one string compressor has a contact portion configured to contact the at least one string;

a frame having a longitudinal axis and a bottom surface, wherein the frame has a recessed portion extending longitudinally, wherein the frame is secured to the neck of the instrument, wherein the recessed portion is configured to position the contact portions of the at least one string compressor at a raised position relative to the at least one string and the fretboard; and means for selectively fixing the frame to a selected portion along the length of the neck of the instrument such that the bottom surface of the frame is positioned at a predetermined distance above the fretboard, wherein the means for selectively fixing the frame to a selected portion along the length of the neck of the instrument comprises a ratcheting ear lock, wherein the ratcheting gear lock is configured to slide along the longitudinal axis of the frame.

10. The capo of claim 9, wherein the contact portion of each string compressor comprises a padded portion.

11. The capo of claim 9, wherein the capo further comprises means for individually moving the contact portions of the at least one string compressor from the raised position to a depressed position, which is at a predetermined depth from the bottom surface of the frame, to selectively apply pressure to at least one string on the instrument, wherein the predetermined depth is less than the predetermined distance, and wherein, in the depressed position, the contact portion of each string compressor of the at least one string compressor presses a selected string among the at least one string against the fretboard.

12. The capo of claim 9, wherein each string compressor of the at least one string compressor is selectively axially moveable therein the recessed portion of the frame along the longitudinal axis of the frame.

13. The capo of claim 11, wherein the means for individually moving the contact portions of the at least one suing compressor comprises at least one actuator, wherein each actuator of the at least one actuator is in operative communication with a string compressor of the at least one string compressor, wherein each actuator of the at least one actuator is selectively moveable between a first position and a second position, wherein the first position of the actuator corresponds to the raised position of the contact portions of the at least one string compressor, and wherein the second position of the actuator corresponds to the depressed position of the contact portions of the at least one string compressor.

14. The capo of claim 13, wherein each actuator comprises a cam.

15. The capo of claim 11, wherein each string compressor of the at least one string compressor comprises a plunger assembly, the plunger assembly comprising:

a housing having at least one opening; and a plunger having an elongate shaft, the elongate shaft having a distal end and a proximal end, wherein the elongate shaft comprises:

a first shoulder positioned at a distal end of the elongate shaft; and a second shoulder positioned intermediate the distal end and the proximal end of the elongate shaft, wherein the housing comprises two opposed bumps on opposed sides of the opening of the housing, wherein the opening of the housing has a diameter that is at least equal to the diameter of the first and second shoulders of the plunger, wherein the distance between the two opposed bumps is less than the diameter of the first and second shoulders of the plunger predetermined distance greater than the distance between the two opposed bumps, wherein the plunger is moveable axially therein the opening of the housing, wherein, in the raised position of the string compressor, the second shoulder is spaced from the opposed bumps and the first shoulder is positioned proximate a lower portion of the opposed bumps, and wherein, in the depressed position of the string compressor, the second shoulder abuts an upper portion of the opposed bumps and the first shoulder is spaced from the opposed bumps.

16. The capo of claim 15, wherein the means for individually moving the contact portions of the at least one string compressor comprises at least one actuator, wherein each actuator of the at least one actuator is in operative communication with a string compressor of the at least one string compressor, wherein each actuator of the at least one actuator is selectively moveable between an up position and a down position, wherein the up position of the actuator corresponds to the raised position of the contact portions of the at least one string compressor, and wherein the down position of the actuator corresponds to the depressed position of the contact portions of the at least one string compressor.

17. The capo of claim 16, wherein each actuator comprises a cam.

18. A capo for use with an instrument having at least one string, the instrument having a neck that has a length and a variable width, wherein an upper surface of the neck defines a fretboard, wherein, in a relaxed position, each string of the at least one string is positioned above the fretboard, the capo comprising:

at least one string compressor, wherein each string compressor of the at least one string compressor has a contact portion configured to contact the at least one string;

a frame having a longitudinal axis, wherein the frame has a recessed portion extending longitudinally, wherein the recessed portion is configured to position the contact portions of the at least one string compressor at a raised position relative to the at least one string and the fretboard, and wherein at least a portion of the frame is threaded;

means for individually moving the contact portions of the at least one string compressor from the raised position to a depressed position, which is at a predetermined depth from a bottom surface of the frame, to selectively apply pressure to at least one string on the instrument; and means for selectively fixing the frame to a selected portion along the length of the neck of the instrument such that the bottom surface of the frame is positioned at a predetermined distance above the fretboard, wherein the predetermined distance is greater than the predetermined depth, wherein the means for selectively fixing the frame to a selected portion along the length of the neck of the instrument comprises a screw clamp, wherein the screw clamp is configured for threaded engagement by the threaded portion of the frame, and wherein, in the depressed position, the contact portion of each string compressor of the at least one string compressor presses a selected string among the at least one string against the fretboard.

19. A capo for use with an instrument having at least one string, the instrument having a neck that has a length and a variable width, wherein an upper surface of the neck defines a fretboard, wherein, in a relaxed position, each string of the at least one string is positioned above the fretboard, the capo comprising:

at least one string compressor, wherein each string compressor of the at least one string compressor has a contact portion configured to contact the at least one string;

a frame having a longitudinal axis and a bottom surface, wherein the frame has a recessed portion extending longitudinally, wherein the frame is secured to the neck of the instrument, wherein the recessed portion is configured to position the contact portions of the at least one string compressor at a raised position relative to the at least one string and the fretboard, and wherein at least a portion of the frame is threaded; and means for selectively fixing the frame to a selected portion along the length of the neck of the instrument such that the bottom surface of the frame is positioned at a predetermined distance above the fretboard, wherein the means for selectively fixing the frame to a selected portion along the length of the neck of the instrument comprises a screw clamp, wherein the screw clamp is configured for threaded engagement by the threaded portion of the frame.

20. A capo for use with an instrument having at least one string, the instrument having a neck that has a length and a variable width, wherein an upper surface of the neck defines a fretboard, wherein, in a relaxed position, each string of the at least one string is positioned above the fretboard, the capo comprising:

at least one string compressor, wherein each string compressor of the at least one string compressor has a contact portion configured to contact the at least one string, and wherein each string compressor of the at least one string compressor comprises a plunger assembly, the plunger assembly comprising:

a housing having at least one opening; and a plunger having an elongate shaft, the elongate shaft having a distal end and a proximal end, wherein the elongate shaft comprises:

a first shoulder positioned at a distal end of the elongate shaft; and a second shoulder positioned intermediate the distal end and the proximal end of the elongate shaft, wherein the housing comprises two opposed bumps on opposed sides of the opening of the housing, wherein the opening of the housing has a diameter that is at least equal to the diameter of the first and second shoulders of the plunger, wherein the distance between the two opposed bumps is less than the diameter of the first and second shoulders of the plunger predetermined distance greater than the distance between the two opposed bumps, wherein the plunger is moveable axially therein the opening of the housing, wherein, in the raised position of the string compressor, the second shoulder is spaced from the opposed bumps and the first shoulder is positioned proximate a lower portion of the opposed bumps, and wherein, in the depressed position of the string compressor, the second shoulder abuts an upper portion a frame having a longitudinal axis, wherein the frame has a recessed portion extending longitudinally, and wherein the recessed portion is configured to position the contact portions of the at least one string compressor at a raised position relative to the at least one string and the fretboard; and means for individually moving the contact portions of the at least one string compressor from the raised position to a depressed position, which is at a predetermined depth from a bottom surface of the frame, to selectively apply pressure to at least one string on the instrument, wherein, in the depressed position, the contact portion of each string compressor of the at least one string compressor presses a selected string among the at least one string against the fretboard.

21. The capo of claim 20, further comprising means for selectively fixing the frame to a selected portion along the length of the neck of the instrument such that the bottom surface of the frame is positioned at a predetermined distance above the fretboard.

22. The capo of claim 21, wherein the predetermined distance is greater than the predetermined depth.

23. The capo of claim 21, wherein the means for selectively fixing the frame to a selected portion along the length of the neck of the instrument comprises a sliding cam lock, wherein the sliding cam lock is configured to slide along the longitudinal axis of the frame.

24. The capo of claim 21, wherein the means for selectively fixing the frame to a selected portion along the length of the neck of the instrument comprises a ratcheting gear lock, wherein the ratcheting gear lock is configured to slide along the longitudinal axis of the frame.

25. The capo of claim 21, wherein the means for selectively fixing the frame to a selected portion along the length of the neck of the instrument comprises a sliding grip claim, wherein the sliding grip claim is configured to slide along the longitudinal axis of the frame.

26. The capo of claim 21, wherein at least a portion of the frame is threaded, and wherein the means for selectively fixing the frame to a selected portion along the length of the neck of the instrument comprises a screw clamp, wherein the screw clamp is configured for threaded engagement by the threaded portion of the frame.

* * * * *